US008218800B2

(12) United States Patent
Fröhlich et al.

(10) Patent No.: US 8,218,800 B2
(45) Date of Patent: Jul. 10, 2012

(54) METHOD FOR SETTING A HEARING SYSTEM WITH A PERCEPTIVE MODEL FOR BINAURAL HEARING AND CORRESPONDING HEARING SYSTEM

(75) Inventors: Matthias Fröhlich, Erlangen (DE); Matthias Latzel, Eggolsheim (DE); Henning Puder, Erlangen (DE); Andre Steinbuss, Erlangen (DE)

(73) Assignee: Siemens Medical Instruments Pte. Ltd., Singapore (SG)

( * ) Notice: Subject to any disclaimer, the term of this patent is extended or adjusted under 35 U.S.C. 154(b) by 1020 days.

(21) Appl. No.: 12/220,467

(22) Filed: Jul. 24, 2008

(65) Prior Publication Data

US 2009/0028363 A1 Jan. 29, 2009

(30) Foreign Application Priority Data

Jul. 27, 2007 (DE) ..... 10 2007 035 173

(51) Int. Cl.
*H04R 25/00* (2006.01)
*H04R 29/00* (2006.01)

(52) U.S. Cl. ..... 381/312; 381/314; 381/317

(58) Field of Classification Search ..... 381/23.1, 381/312–321, 58, 60
See application file for complete search history.

(56) References Cited

U.S. PATENT DOCUMENTS 5,524,056 A * 6/1996 Killion et al. ..... 381/314
5,825,894 A * 10/1998 Shennib ..... 381/60
6,912,289 B2 * 6/2005 Vonlanthen et al. ..... 381/312
6,983,055 B2 * 1/2006 Luo ..... 381/313
7,076,072 B2 * 7/2006 Feng et al. ..... 381/313
7,181,033 B2 * 2/2007 Fischer et al. ..... 381/317
7,236,603 B2 * 6/2007 Mergell ..... 381/312
7,813,517 B2 * 10/2010 Klemenz et al. ..... 381/317
7,881,487 B2 * 2/2011 Dickel et al. ..... 381/314
2002/0037088 A1 * 3/2002 Dickel et al. ..... 381/317
2002/0111745 A1 * 8/2002 Bye et al. ..... 702/19
2007/0160242 A1 * 7/2007 Cadalli et al. ..... 381/312
2008/0112583 A1 * 5/2008 Kornagel ..... 381/314
2008/0137889 A1 * 6/2008 Rass ..... 381/314
2009/0238370 A1 * 9/2009 Rumsey et al. ..... 381/58
2009/0304188 A1 * 12/2009 Mejia et al. ..... 381/23.1

FOREIGN PATENT DOCUMENTS

DE 103 08 483 A1 9/2004
EP 0 661 905 A2 7/1995
EP 0 915 639 A1 5/1999

* cited by examiner

*Primary Examiner* — Edgardo San Martin

(57) ABSTRACT

A hearing system is provided that includes a left device that supplies an electrical sound signal for supplying the left ear of the user, and a right device that supplies an electrical sound signal for supplying the right ear of the user. A perceptive model for binaural hearing is implemented at least in one of the two devices or a further device belonging to the hearing system, with which a left setting value for the left device and/or a right setting value for the right device can be determined on the basis of the two sound signals. The left device can then be set with the left setting value and/or the right device with the right setting value. The entire process of the binaural hearing and not only the monaural hearing is thus taken into consideration for the setting of the hearing system.

14 Claims, 2 Drawing Sheets

METHOD FOR SETTING A HEARING SYSTEM WITH A PERCEPTIVE MODEL FOR BINAURAL HEARING AND CORRESPONDING HEARING SYSTEM

CROSS REFERENCE TO RELATED APPLICATIONS

This application claims priority of German application No. 10 2007 035 173.0 DE filed Jul. 27, 2007, which is incorporated by reference herein in its entirety.

FIELD OF INVENTION

The present invention relates to a method for setting a hearing system having a left device and a right device for binaural supply of a user, with an electrical sound signal being provided for supplying the left ear of the user and an electrical sound signal being provided to supply the right ear of the user. The present invention also relates to a corresponding hearing system for binaural supply. A hearing system is understood here to mean in particular a hearing device system for supplying the hearing-impaired, but also a headset or earphones and similar device systems which can be worn on the ear.

BACKGROUND OF INVENTION

Hearing devices are wearable hearing apparatuses which are used to assist the hard-of-hearing. In order to accommodate numerous individual requirements, various types of hearing devices are available such as behind-the-ear (BTE) hearing devices, hearing device with an external receiver (RIC: receiver in the canal) and in-the-ear (ITE) hearing devices, for example also concha hearing devices or completely-in-the-canal (ITE, CIC) hearing devices. The hearing devices listed as examples are worn on the outer ear or in the auditory canal. Bone conduction hearing aids, implantable or vibrotactile hearing aids are also available on the market. The damaged hearing is thus stimulated either mechanically or electrically.

The key components of hearing devices are principally an input converter, an amplifier and an output converter. The input converter is normally a receiving transducer e.g. a microphone and/or an electromagnetic receiver, e.g. an induction coil. The output converter is most frequently realized as an electroacoustic converter e.g. a miniature loudspeaker, or as an electromechanical converter e.g. a bone conduction hearing aid. The amplifier is usually integrated into a signal processing unit. This basic configuration is illustrated in FIG. 1 using the example of a behind-the-ear hearing device. One or a plurality of microphones 2 for recording ambient sound are built into a hearing device housing 1 to be worn behind the ear. A signal processing unit 3 which is also integrated into the hearing device housing 1 processes and amplifies the microphone signals. The output signal for the signal processing unit 3 is transmitted to a loudspeaker or receiver 4, which outputs an acoustic signal. Sound is transmitted through a sound tube, which is affixed in the auditory canal by means of an otoplastic, to the device wearer's eardrum. Power for the hearing device and in particular for the signal processing unit 3 is supplied by means of a battery 5 which is also integrated in the hearing device housing 1.

It is possible for a hearing system to be automatically controlled by means of a perceptive model, namely in the form such that psychoacoustic dimensions, like for instance volume, convenience, hearing effort etc. are optimized.

The publication EP 0 661 905 A2 describes a similar method for adjusting a hearing device and a corresponding hearing device. A perceptive model obtains a psychoacoustic variable, in particular the loudness, on the one hand for a standard group of people and on the other hand for a single person. Control details are determined on the basis of the difference of the two psychoacoustic variables, with the signal transmission to a hearing device being configured or set ex situ and/or being conducted in situ.

The publication US 2002/0111745 A1 also discloses a wearable hearing analysis system. Parameters of a hearing response can be obtained here by an audiometer. A response prediction is used to perform a basic setting of a hearing device.

SUMMARY OF INVENTION

In the case of a binaural adjustment, the parameters for the left and the right device may be different. Possible causes of this may be clearly different signals on the right and left, but also different hearing losses on both sides. The modifications to the configuration of the hearing system resulting herefrom can likewise be different binaurally, so that a hearing impression potentially arises which is different depending on the side. This is impractical particularly for algorithms like interference noise elimination and directional microphony.

The object of the present invention thus consists in providing a method, with which the setting of a hearing system for binaural supply can take place in an improved and individual fashion. A corresponding hearing system is also to be provided.

This object is achieved in accordance with the invention by a method for setting a hearing system having a left device and a right device for the binaural supply of a user, by providing an electrical sound signal for supplying the left ear of the user and providing an electrical sound signal for supplying the right ear of the user, as well as determining on the basis of the two sound signals of a left setting value for the left device and a right setting value for the right device by means of a perceptive model for binaural hearing and setting the left device with the left setting value as well as the right device with the right setting value.

Provision is also made in accordance with the invention for a hearing system having a left device, which supplies an electrical sound signal for supplying the left ear of the user and a right device, which supplies an electrical sound signal for supplying the right ear of the user, with a perceptive model being implemented for binaural hearing at least in one of the two devices or a further device belonging to the hearing system, with which a left setting value for the left device and/or a right setting value for the right device can be determined on the basis of the two sound signals and the left device can be set with the left setting value and/or the right device can be set with the right setting value.

It is thus advantageously possible to take the binaural perception of sounds into consideration while automatically controlling a hearing system. This allows the acceptance of hearing systems with binaural supply to be improved significantly.

The two setting values for the left device and the right device are preferably identical. A symmetrical hearing impression can be achieved in this way.

In particular, the two setting values can trigger the activation or deactivation of an interference noise elimination function and/or a directional microphone function of both devices.

Functions which influence the binaural hearing impression significantly are thus controlled on the basis of psychoacoustic model values.

The speech intelligibility and/or the localization effect can also be used here as leading psychoacoustic variables when determining the setting values by means of the perceptive model of the noise impression. Other psychoacoustic variables such as intensity, roughness, hearing effort etc. can however also be used.

According to a particular embodiment, the perceptive model for binaural hearing obtains a psychoacoustic variable from a perceptive model for monaural perception from each of the two devices in each instance in order to determine the setting values. It is possible in this way to distribute the computing outlay for a perceptive model for binaural hearing onto two hearing devices.

BRIEF DESCRIPTION OF THE DRAWINGS

The present invention is described in more detail with reference to the appended drawings, in which.

DETAILED DESCRIPTION OF INVENTION

The exemplary embodiment illustrated in more detail below represents a preferred embodiment of the present invention.

Figure 1:
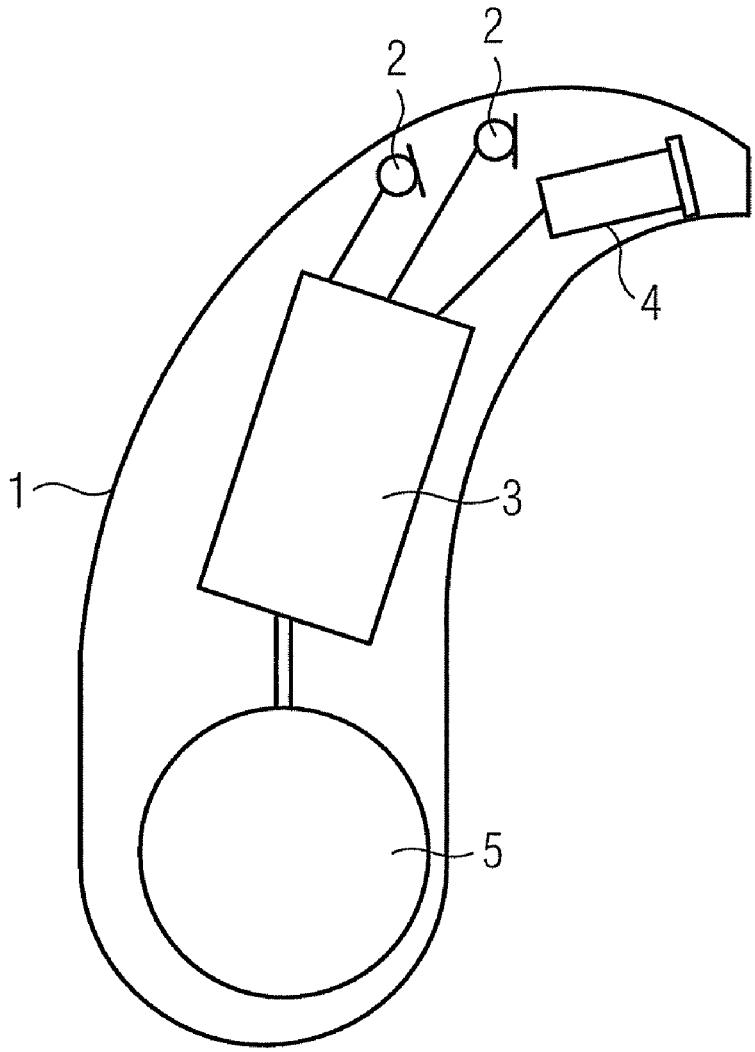
FIG 1 (Prior art)
FIG. 1 shows the basic design of a hearing device according to the prior art.
Figure 2:
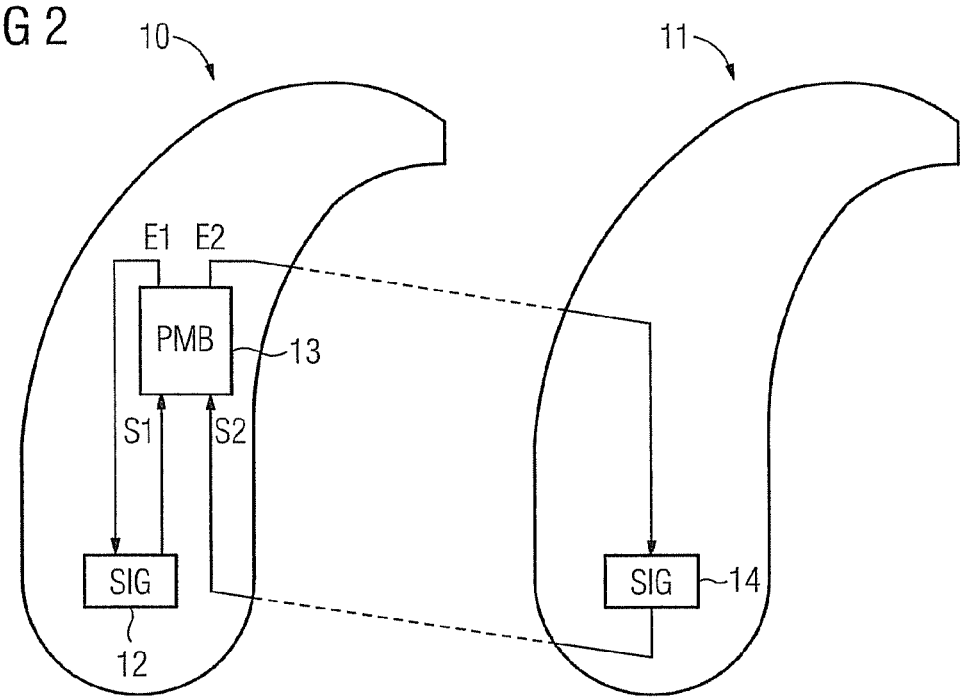
FIG. 2 shows a schematic representation of a hearing system with a perceptive model for binaural hearing according to a first embodiment of the present invention and FIG. 3 shows a schematic representation of a hearing system with a perceptive model for binaural hearing according to a second embodiment of the present invention.

FIG. 2 shows a hearing device system with a left and/or right hearing device 10 and a right and/or second hearing device 11. The two hearing devices 10, 11 are preferably wirelessly connected in a data link, which is shown in FIG. 2 by the dashed lines.

The first hearing device 10 has a signal processing unit 12, which supplies an electrical sound signal S1 to a modeling facility 13, in which a perceptive model for binaural hearing is implemented. This perceptive model for binaural hearing supplies a statement relating in particular to the hearing impression that the hearing-impaired person has of a sound, which he/she perceives by way of both ears. The binaural perception is actually very different from the monaural perception, since during hearing a sound is perceived louder with two ears for instance than when hearing with only one ear. Psychoacoustic variables can also be obtained in the perceptive model for binaural hearing by way of perceptions, which are only possible with two ears, like for instance localization effect.

The signal processing unit 12 can be a signal processor, a simple microphone or any other unit which supplies an electrical signal based on an input sound. The second hearing device 11 also has a signal processing unit 14 of this type. This supplies a second sound signal S2 to the first hearing device 10 wirelessly by way of a corresponding communication facility, so that it can be processed by the modeling facility 13. This now supplies two setting signals E1 and E2 on the basis of the two sound signals S1 and S2. The left and/or first setting signal E1 is determined for the signal processing unit 12 which is inside the hearing device. The right and/or second setting signal E2 is transmitted to the second hearing device 11 and fed there to the signal processing unit 14. The setting values E1 and E2 are determined for binaural hearing on the basis of psychoacoustic perception variables and are now used to set components of the two devices of the hearing system. In this way, those units, which supply the sound signals S1 and S2, need not necessarily be set, but other components can also be set with the setting signals E1 and E2 of the respective hearing device 10, 11.

Figure 3:
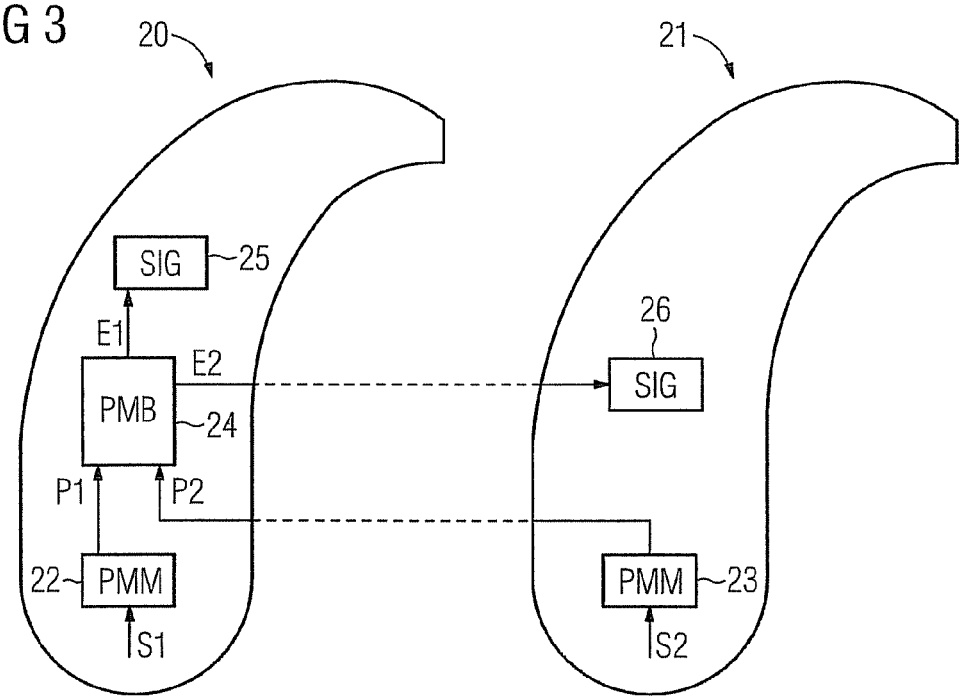

An alternative embodiment is shown schematically in FIG. 3. The hearing device system again consists of two hearing devices 20 and 21. The first hearing device 20 has a first modeling facility 22, in which a perceptive model is implemented for monaural hearing. A first sound signal S1, which originates from a microphone or any other signal processing unit of the first hearing device 20, is received in order to generate a first psychoacoustic variable P1. A second sound signal S2, which originates from a microphone or a signal processing unit located there, is recorded at the same time in the second hearing device 21 by a modeling facility 23 and is processed to form a second psychoacoustic variable P2. This is in turn preferably wirelessly transmitted to the first hearing device 20 and is supplied here by a second modeling facility 24, in which a perceptive model is implemented for binaural hearing. The latter generates two setting signals E1 and E2 for signal processing components 25 and 26 of the two hearing devices 20, 21 on the basis of the two psychoacoustic signals P1 and P2. A binaural perceptive model is thus used here to combine the monaural model statements to form a single statement and/or to change one of the two sides such that an optimum noise impression, an optimum speech intelligibility and/or an optimum localization effect etc. is achieved.

Parameters of both hearing devices of a hearing system can be symmetrically modified with the aid of the common perceptive model for binaural hearing, if necessary on the basis of a binaural decision matrix, in order overall to obtain a symmetrical hearing impression. Furthermore, the symmetrical activation and/or deactivation of further adaptive parameters is possible like an interference noise elimination or a directional microphone. In this way, the aim is likewise to offer a symmetrical hearing impression for the hearing system wearer.

The two setting signals E1 and E2 may be different if they relate to the amplification for instance and the hard-of-hearing have different deficits on both ears. If however this concerns activating and/or deactivating the interference noise elimination or a directional microphone, the two setting signals E1 and E2 are to be identical. The two hearing devices can thus be synchronized on the basis of the perceptive model for binaural perception and a symmetrical hearing impression can be achieved.

The present invention consequently allows the entire hearing consisting of a left and a right part to be psychoacoustically evaluated and setting parameters for the individual devices of a hearing system to be obtained.

The invention claimed is:

1. A method for setting a hearing system having a first device and a second device for the binaural supply of a user, comprising:

receiving an input sound via a first device and providing an electrical sound signal for supplying an ear of the user based on the input sound to a common perceptive model for binaural hearing;

receiving the input sound via a second device and providing an electrical sound signal for supplying another ear of the user based on the input sound to the common perceptive model for binaural hearing located in the first device via a communication facility between devices;

determining on the basis of the two sound signals a first setting value for the first device and a second setting value for the second device via the common perceptive model for binaural hearing; and setting the first device with the first setting value and transmitting via the communication facility the second setting value to the second device for setting the second device.

2. The method as claimed in claim 1, wherein the two setting values are identical for the first device and the second device to allow synchronization of the two devices for settings that do not depend on different deficits on both ears.

3. The method as claimed in claim 2, wherein the two identical setting values trigger an activation or deactivation of an interference noise elimination function and a directional microphone function of both devices in order to synchronize the hearing devices.

4. The method as claimed in claim 2, wherein the two identical setting values trigger an activation or deactivation of an interference noise elimination function or a directional microphone function of both devices in order to synchronize the hearing devices.

5. The method as claimed in claim 1, wherein a speech intelligibility and a localization effect are used as a leading psychoacoustic variable of the sound impression when determining the setting values via the common perceptive model.

6. The method as claimed in claim 1, wherein a speech intelligibility or a localization effect is used as a leading psychoacoustic variable of the sound impression when determining the setting values via the common perceptive model.

7. The method as claimed in claim 1, wherein the electrical sound signals of the first and second device are first provided to respective perceptive models for monaural perception in each of the two devices and then provided to the common perceptive model for binaural hearing in each instance in order to determine the setting values.

8. A hearing system, comprising:

a first device that receives an input sound and supplies an electrical sound signal for supplying an ear of the user based on the input sound to a common perceptive model for binaural hearing;

a second device that receives the input sound and supplies an electrical sound signal for supplying another ear of the user based on the input sound to the common perceptive model for binaural hearing; and wherein the common perceptive model for binaural hearing is implemented at least in one of the two devices or a further device belonging to the hearing system, and determines a first setting value for the first device and a second setting value for the second device based on the two sound signals, wherein the first device is set with the first setting value and the second device is set with the second setting value.

9. The hearing system as claimed in claim 8, wherein the two setting values are identical for the first device and the second device to allow synchronization of the two devices for settings that do not depend on different deficits on both ears.

10. The hearing system as claimed in claim 9, wherein the two devices comprise an interference noise elimination facility and a directional microphone facility that are activated or deactivated on the basis of the two identical setting values in order to synchronize the hearing devices.

11. The hearing system as claimed in claim 9, wherein the two devices comprise an interference noise elimination facility or a directional microphone facility that is activated or deactivated on the basis of the two identical setting values in order to synchronize the hearing devices.

12. The hearing system as claimed in claim 8, wherein with a speech intelligibility and a localization effect are used as a leading psychoacoustic variable of the sound impression when determining the setting values via the common perceptive model.

13. The hearing system as claimed in claim 8, wherein with a speech intelligibility or a localization effect is used as a leading psychoacoustic variable of the sound impression when determining the setting values via the common perceptive model.

14. The hearing system as claimed in claim 8, wherein a perceptive model for monaural perception is implemented in the first device and in the second device in each instance to receive the electrical sound signals of the first and second device and provide a psychoacoustic variable for the monaural perceptive model by both devices in each instance to the common perceptive model for binaural hearing in order to determine the setting values.

* * * * *